US008444011B2

(12) United States Patent
Paauwe et al.

(10) Patent No.: US 8,444,011 B2
(45) Date of Patent: May 21, 2013

(54) TAPPING APPARATUS WITH PRESSURE CONTROL MEANS

(75) Inventors: Arie-Maarten Paauwe, De Lier (NL); Antonius Maurits Willemen, Utrecht (NL); Engbert Hermannes Pakkert, Delft (NL)

(73) Assignee: Heineken Supply Chain B.V., Amsterdam (NL)

( * ) Notice: Subject to any disclaimer, the term of this patent is extended or adjusted under 35 U.S.C. 154(b) by 612 days.

(21) Appl. No.: 12/515,001

(22) PCT Filed: Nov. 15, 2007

(86) PCT No.: PCT/NL2007/050566

§ 371 (c)(1),
(2), (4) Date: Dec. 1, 2009

(87) PCT Pub. No.: WO2008/060152

PCT Pub. Date: May 22, 2008

(65) Prior Publication Data

US 2010/0084435 A1 Apr. 8, 2010

(30) Foreign Application Priority Data

Nov. 17, 2006 (NL) ..... 1032892

(51) Int. Cl.

| | |
|---|---|
| ***B67B 7/00*** | (2006.01) |
| ***B67B 1/00*** | (2006.01) |
| ***B67D 7/06*** | (2010.01) |
| ***B65D 83/00*** | (2006.01) |

(52) U.S. Cl.

USPC ..... 222/1; 222/23; 222/153.11; 222/399

(58) Field of Classification Search ..... 222/153.01, 222/153.09, 153.11, 394, 396, 397, 399, 222/400.7

See application file for complete search history.

(56) References Cited

U.S. PATENT DOCUMENTS

| | | | | | |
|---|---|---|---|---|---|
| 597,292 | A | * | 1/1898 | Linder et al. | 222/396 |
| 927,298 | A | * | 7/1909 | Twitchell | 73/744 |
| 1,412,321 | A | * | 4/1922 | Tate | 222/399 |
| 1,920,165 | A | * | 8/1933 | Andvig | 222/80 |
| 3,298,575 | A | * | 1/1967 | Larsen | 222/399 |
| 3,384,267 | A | * | 5/1968 | Trumble | 222/5 |
| 3,411,669 | A | * | 11/1968 | Puster | 222/61 |
| 3,517,932 | A | * | 6/1970 | Clinkscales | 222/399 |
| 3,519,170 | A | * | 7/1970 | Lankelma, Jr. | 222/212 |
| 3,613,954 | A | * | 10/1971 | Bayne | 222/61 |
| 3,762,431 | A | * | 10/1973 | Wilson et al. | 137/116.3 |

(Continued)

FOREIGN PATENT DOCUMENTS

| | | |
|---|---|---|
| DE | 19825343 A1 | 3/1999 |
| EP | 1003686 A1 | 5/2000 |

(Continued)

*Primary Examiner* — Kevin P Shaver
*Assistant Examiner* — Patrick M Buechner
(74) *Attorney, Agent, or Firm* — Pearne & Gordon LLP

(57) ABSTRACT

A tapping apparatus (1), provided with a container (2) and a pressure control device (10) for controlling pressure in an inner space (3) of the container, wherein the pressure control device (10) includes a compartment (31) with a pressure medium therein and a dispensing opening (30) with a valve mechanism (12), wherein an operating element (15) is provided for operation of the valve mechanism by a user, for supplying an amount of pressure medium from the compartment (31) into an inner space (3) of the container.

29 Claims, 9 Drawing Sheets

U.S. PATENT DOCUMENTS

| | | | | | |
|---|---|---|---|---|---|
| 3,780,693 | A | * | 12/1973 | Parr | 116/270 |
| 4,402,429 | A | * | 9/1983 | Vanden Driessche | 222/153.01 |
| 4,632,276 | A | * | 12/1986 | Makino | 222/80 |
| 5,110,012 | A | * | 5/1992 | Scholle et al. | 222/83.5 |
| 5,110,014 | A | * | 5/1992 | Doundoulakis | 222/396 |
| 5,140,982 | A | * | 8/1992 | Bauman | 128/205.13 |
| 5,443,186 | A | * | 8/1995 | Grill | 222/396 |
| 6,412,668 | B1 | | 7/2002 | Vlooswijk et al. | |
| 6,415,963 | B1 | | 7/2002 | Vlooswijk et al. | |
| 6,745,922 | B1 | | 6/2004 | Vlooswijk et al. | |
| 7,077,298 | B2 | | 7/2006 | Vlooswijk et al. | |
| 8,177,103 | B2 | * | 5/2012 | Pakkert et al. | 222/399 |
| 2003/0071078 | A1 | * | 4/2003 | Park | 222/397 |
| 2004/0050879 | A1 | | 3/2004 | Vlooswijk et al. | |
| 2006/0169725 | A1 | * | 8/2006 | Grill | 222/399 |
| 2008/0203118 | A1 | | 8/2008 | Sauer et al. | |
| 2009/0302069 | A1 | * | 12/2009 | Oberhofer et al. | 222/399 |

FOREIGN PATENT DOCUMENTS

| | | | | |
|---|---|---|---|---|
| EP | 1688813 | A | | 8/2006 |
| WO | 0035803 | A1 | | 6/2000 |
| WO | 0242197 | A1 | | 5/2002 |
| WO | 02/081067 | A2 | | 10/2002 |
| WO | WO 2005012157 | A1 | * | 2/2005 |

* cited by examiner

TAPPING APPARATUS WITH PRESSURE CONTROL MEANS

FIELD OF THE INVENTION

The invention relates to a tapping apparatus for dispensing beverage.

BACKGROUND OF THE INVENTION

In WO 00/35803, a tapping apparatus is described for dispensing beverage, in particular carbonated beverage. This tapping apparatus comprises a container with an inner space in which the beverage is received and which is provided with dispensing means for dispensing the beverage. A pressure control device is included in the inner space of the container and is provided with a compartment in which a gas is included under excess pressure. A driving means is provided which automatically operates a shut-off of said compartment on the basis of pressure changes in the inner space of the container, for supply to the inner space when the pressure therein drops below a desired level. In NL 1012921, a comparable apparatus is described, wherein means are provided for activating the pressure control device within the inner space.

With these known apparatuses, the pressure of the beverage in the inner space is automatically controlled. Each time the pressure in the inner space is reduced, for instance in that beverage is dispensed, gas is supplied for returning the pressure to be desired level. However, such a pressure control device can be relatively expensive. Such a pressure control device can further be susceptible to malfunction, so that risk exists that no more gas is supplied, also when not all beverage has been dispensed yet.

From practice, tapping apparatuses are known with which from the outside, gas under pressure is supplied. For instance, a $CO_2$ bottle can be connected via a gas duct to a beer keg, while an expensive and complicated pressure control is included in the gas duct for reducing the gas pressure. However, this is a relatively complicated and expensive installation, both in build-up and purchase and in use, which, furthermore, can hardly be moved, if at all. Also, tapping apparatuses are known with which, on the dispensing means, a manually operated pump is provided with which air can be pumped into the inner space, in order to pressurize the beverage. With such a tapping apparatus however, the quality of the beverage is a relatively rapidly affected by, especially, oxygen in the air, and, optionally, by contaminations entrained by the air from the surroundings. Furthermore, this requires great efforts from the user and the pressure can only be poorly controlled.

In EP 1003686, a tapping apparatus is described wherein a bag-in-container type container can be placed, while the tapping apparatus is provided with an air pump with which air can be introduced between the container and the inner "bag". With this, the inner bag is pressurized and the beverage can be dispensed. Thus, contamination or other harmful effects to the beverage by the air are prevented. Such a tapping apparatus requires an appliance for dispensing the beverage and, furthermore, the use of the tapping apparatus is limited to locations where electricity is available.

The object of the invention is to provide a tapping apparatus which solves at least one of the above-mentioned drawbacks or limitations of the known tapping apparatuses, or offers an improvement relative to at least one of those apparatuses.

SUMMARY OF THE INVENTION

In a first aspect, the tapping apparatus according to the invention is characterized that it is provided with a container and a pressure control device for controlling pressure in an inner space of the container, wherein the pressure control device comprises a compartment with a pressure medium therein and a dispensing opening with a valve mechanism, wherein operating means are provided for operation of the valve mechanism by a user, for supplying an amount of pressure medium from the compartment into an inner space of the container. The operating means can be operated by the user, so that there is no longer any need for an automatic pressure control. The user can determine whether and when the pressure in the inner space of the container can or should be increased. Furthermore, with such an apparatus, in an advantageous embodiment, the possibility can be offered to set the pressure in the inner space and, hence, the pressure at with the beverage is dispensed.

In a second aspect, a tapping apparatus according to the invention is characterized in that an indicator is provided with which the pressure in the inner space can be read out, which indicator is preferably mechanical, so that no electricity is required for the use of the tapping apparatus. In an advantageous embodiment, the indicator can at least partly be included in the operating means, so that direct feedback can be obtained. For instance, the pressure in the inner space can directly engage the indicator which can be operated (as operating means) by the user for operating the shut-off or at least for supplying pressure medium to the inner space. Then, preferably, according as the pressure in the inner space increases, the force required for operating the operating means will increase, as tactile indicator.

In a further aspect, the invention is characterized by a method for tapping beverage, wherein the beverage is included in the container with a dispensing device, which container is further provided with a compartment with a compressed pressure medium, while, with the aid of operating means, a shut-off of the compartment is operated such that pressure medium flows under pressure into an inner space of the container and thus pressurizes the beverage and beverage is discharged from the inner space by operating the dispensing device.

BRIEF DESCRIPTION OF THE DRAWINGS

In clarification of the invention, exemplary embodiments of the tapping apparatus and pressure control, and of a method according to the invention will be further elucidated with reference to the drawing. In the drawing.

DETAILED DESCRIPTION OF PREFERRED EMBODIMENTS OF THE INVENTION

Figure 1:
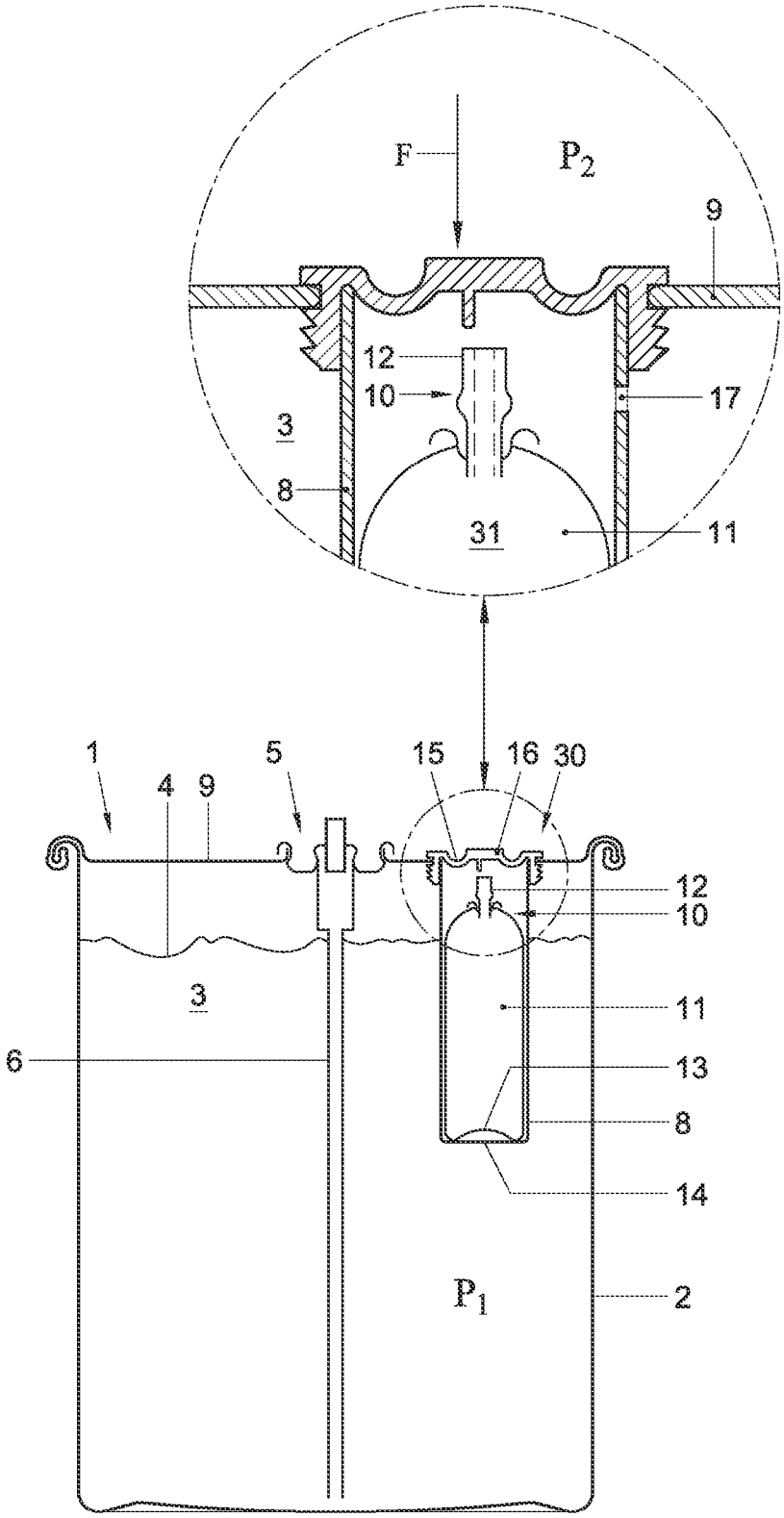
FIG. 1 schematically shows, in cross-sectional side view, a tapping apparatus according to the invention, with removed tapping means, and slightly enlarged, a part of the pressure control device with operating means.

In this description, identical or corresponding parts have identical or corresponding reference numerals. The exemplary embodiments shown are shown merely by way of illustration and should not be construed to be limitative in any manner. The embodiments shown should all be considered to be schematic. In the embodiments shown, apparatuses and methods will be described on the basis of tapping apparatuses for carbonated beverage, in particular beer. However, also other beverages can be dispensed therewith.

In FIG. 1, a part of a tapping apparatus 1 is shown, in particular of the container 2 with an inner space 3 in which beverage 4, in particular carbonated beverage, such as beer, is received. A valve 5 is provided, shown in the shape of the dispensing valve, such as an aerosol valve, coupled to a diptube 6 for dispensing beverage. Tapping means 39 (not shown in FIG. 1 but indeed shown in FIG. 5) can be connected to the valve 5 for dispensing the beverage, for instance to a glass. Such tapping means are known from, for instance, WO 00/35803 or WO 02/42197, which are understood to be incorporated herein by reference. The valve 5 can also be provided at a different position, for instance in a circumferential wall 7, while the tapping means can also be designed differently, for instance as a pull-tap as utilized in gravity-cans.

In the inner space 3, a holder 8 is provided, for instance integrated with or attached to the upper side 9 of the container, wherein a pressure control 10 is placed. In this embodiment, the pressure control 10 is designed as pressure container 11, for instance of the aerosol type or spray can type, with a valve 12, for instance an aerosol valve. A compartment 31 is provided in the pressure container 11, in which a pressure medium is stored under relatively high pressure. In the embodiment shown, for instance $CO_2$ is stored therein. The pressure medium may have been directly introduced into the compartment and stored under, for instance, a few bar of excess pressure, for instance between 5 and 15 bar, but in an advantageous embodiment, a medium absorbing and/or adsorbing the pressure medium is included in the compartment, so that more pressure medium can be included at the same pressure, or the same amount of pressure medium at a lower pressure. For $CO_2$ as pressure medium, for instance activated carbon or other $CO_2$ binding substances can be included. The pressure control 10 is placed by a bottom surface 13 on the bottom 14 of the holder 8, so that the valve 12 projects upwards, i.e. in the direction of the upper side 9. In this upper side 9, the holder 8 is provided with an opening 30, which is sealed off by an operating means 15, in the example shown a somewhat flexible membrane 16, for instance of plastic, metal or rubber. The seal is preferably such that no gas or beverage can escape from the inner space. In the holder, at least one opening 17 is provided through which there is an open communication with the inner space 3. By pressing on the membrane 16, the valve 12, designed here as a male valve 12, is pressed-in so that pressure medium can flow from the compartment 31 and, via the at least one opening 17, can arrive in the inner space 3 for therein increasing the pressure and/or compensating for the pressure loss that may occur by tapping beverage or by temperature reduction.

It will be clear that in a comparable manner, female valves and/or tilting valves or other spring-loaded valves can be utilized, optionally operable by a stem or other pressing element at the underside of the membrane.

Figure 6:
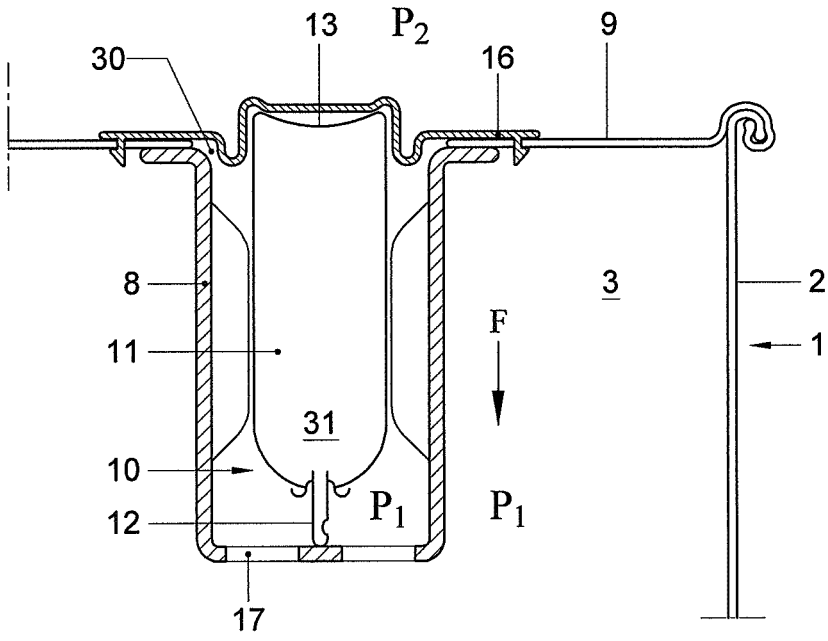
FIG. 6 schematically shows an operating means with cover.

FIG. 6 shows a part of an apparatus 1 according to the invention, in particular a pressure control 10 comparable to the one according to FIG. 1, wherein, nevertheless, the pressure control 10 is placed with the valve 12 downwards into the holder 8. The holder 8 is attached to the inside of the upper side 9. A membrane 16 extends over the bottom surface 13 and seals off the opening 30. When, for instance, a finger or part of the tapping apparatus presses on the membrane 16, the pressure control is lowered, in the direction F, and with it, the valve 12 is opened. Then, gas can escape under pressure from the compartment 31, through the openings 17 to the inner space 3.

In an alternative embodiment, the membrane can be selected such that the pressure $P_2$ at the outside, together with the spring force of the membrane forms a control pressure $P_r$ such that when the pressure $P_1$ in the inner space 3 of the container drops below the control pressure $P_r$, the membrane automatically presses the pressure control downwards, in the direction F, thereby increasing the pressure $P_1$ to the desired control pressure $P_r$, so that the membrane is returned to the initial position. If the pressure in the inner space 3 is, all the same, too low in the opinion of a user, he can still press the membrane in and thus increase the pressure.

Preferably, with an apparatus 1 according to the invention, the holder 8 has already been provided prior to filling and the pressure control is preferably provided at the filling line or even after that, as is the membrane 16.

Figure 2:
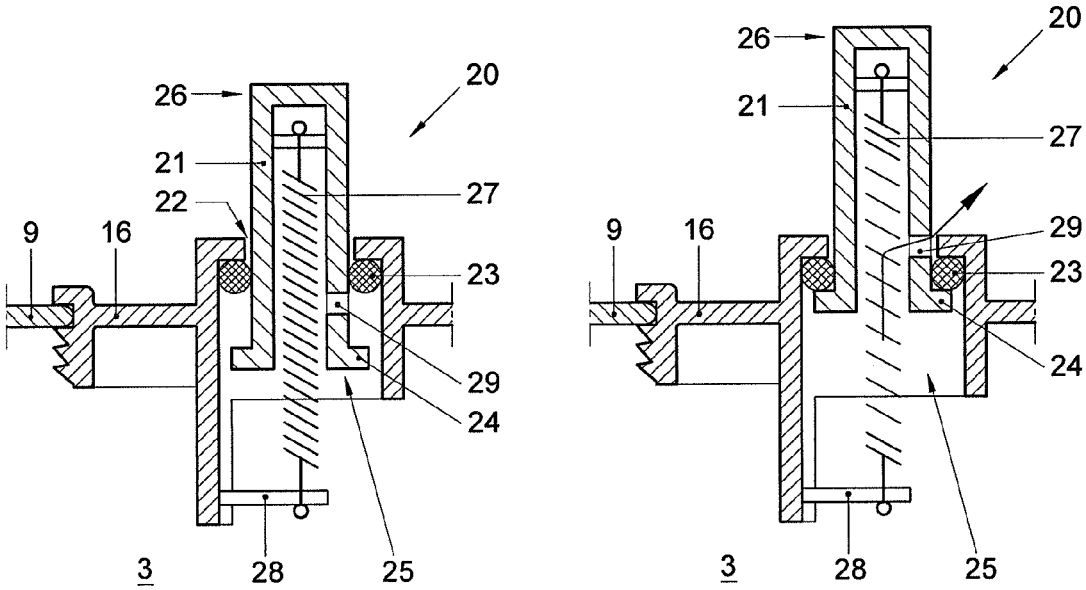
FIG. 2 schematically shows an indicator according to the invention, in two different positions.

FIG. 2 shows an indicator 20 for pressure in the inner space 3, in this embodiment designed as mechanical indicator. In this embodiment, the indicator is provided in the membrane 16 and comprises a hollow stem 21 which reaches through an opening 22 and seals off by means of a suitable gasket 23 such as an O-ring. The stem 21 is provided, on a first end 25 proximal to the inner space, with a collar 24 which prevents the stem 21 from shooting through the opening 22, while the opposite second end 26 is closed off. Adjacent the second end 26, within the stem 21, a spring 27 is secured, which is connected to a part 28 of the membrane 16. The spring 27 is preferably somewhat biased, so that the stem 21 is biased in the direction of said part 28. The part 28 prevents the second end 26 from being pulled through the opening 22 into the inner space 3.

In a first position, the stem will be pulled maximally into the inner space 3 of the container 2, in which position the stem extends only over a minimum height outside the container 2. This is a low pressure indication. The fact is that the pressure $P_{low}$ in the inner space 3 of the container 2 is insufficient for pressing the stem 21 against the spring pressure upwards through the opening 22. When the pressure in the inner space 3 is increased, the stem 21 will be pressed further outwards so that a larger part thereof becomes visible to a user. Thus, an impression is given of the pressure in the inner space. Preferably, a graduation is provided, for instance on the outside of the stem 21, from which the pressure can be read out. With this, the user can always see whether the optimal pressure or the pressure desired by him is obtained or whether the operating means still need operating for increasing the pressure.

In the embodiment shown in FIG. 2, in the stem 21, adjacent the first end, an excess pressure opening 29 is provided such that when the collar 24 is moved against the gasket 23, the opening reaches outside the inner space 3 and gas can escape from the inner space. As a result, the pressure is reduced again and the stem will be retracted by the spring, so that the opening is sealed off again or terminates in the inner space. Thus, an excess pressure protection is obtained. The maximally raised position without an optional excess pressure opening 29 being released can be indicated as a $P_{high}$.

Figure 3:
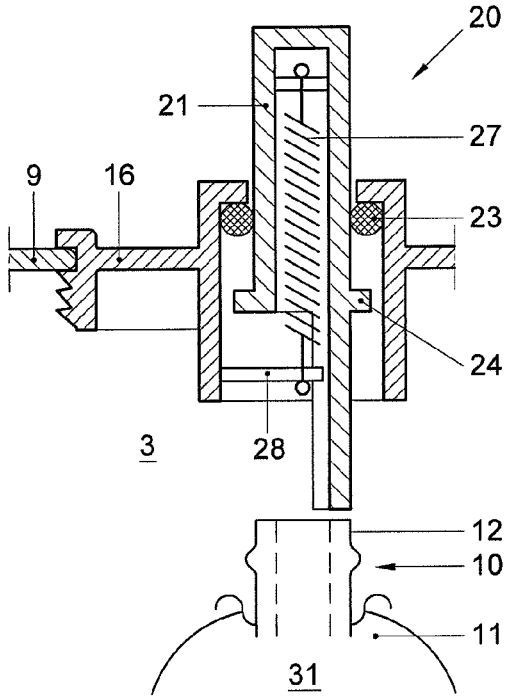
FIG. 3 shows an embodiment of an indicator integrated into the operating means.

In FIG. 3, schematically, an indicator 20 is shown which, at the same time, forms an operating means 15. Here, the stem 21 is placed directly above the valve 12 (in an embodiment comparable to that shown in FIG. 1) or directly above the bottom 13 (in an embodiment comparable to the one according to FIG. 6) such that by pressing the indicator 20 in, at least the stem 21 thereof, the valve 12 is somewhat pressed open and gas can escape.

Figure 4:
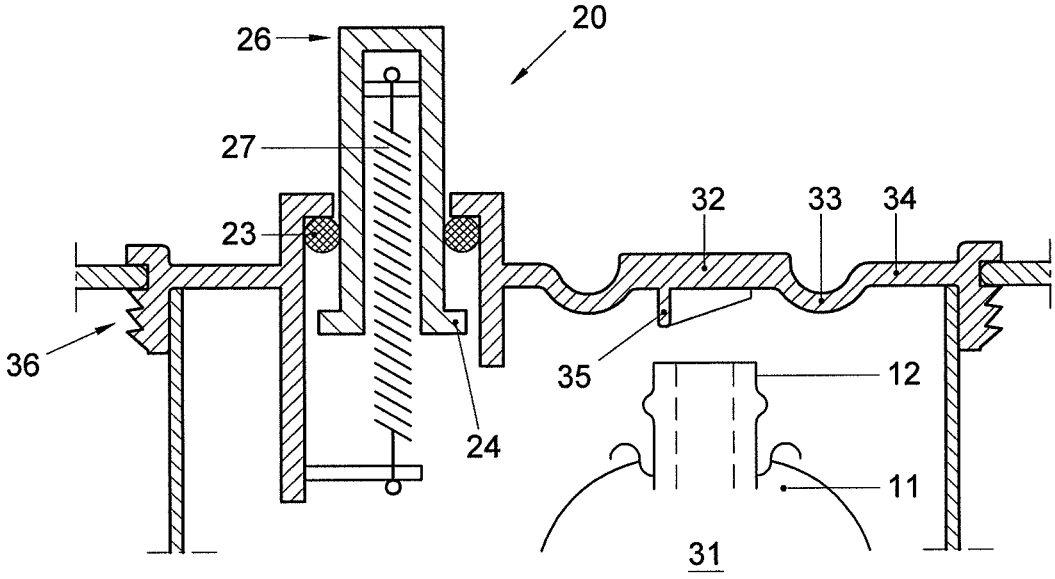
FIG. 4 schematically shows, in cross-sectional side view, a part of a container with pressure control device and operating means.

FIG. 4 schematically shows, in cross-sectional view, a part of a container 2 with a pressure control 8 therein and a pressure indicator 20, while the indicator 20, comparable to the one as described on the basis of FIGS. 2 and 3, is provided in an operating means 15 in the form of a membrane 16, wherein a middle part 32 of the membrane 16, via a flexible ring 33, is connected to the surrounding part 34 of the membrane 16 such that this middle part 32, which comprises an operating element 35 for the valve 12, can be moved downwards relatively simply relative to the surrounding part 34 for releasing gas under pressure. In FIG. 4, the membrane 16 is provided with a ring 36 which extends along an outer circumference and allows simple attachment in the opening 30 through a fitting relief, snap means or other means for gas-tight and liquid-tight attachment. A membrane 16 can be manufactured from, for instance a flexible plastic, from relatively thin metal or the like, while the flexible ring 33 offers the possibility to design a part 34 in which the indicator is included to be more rigid.

Figure 4A:
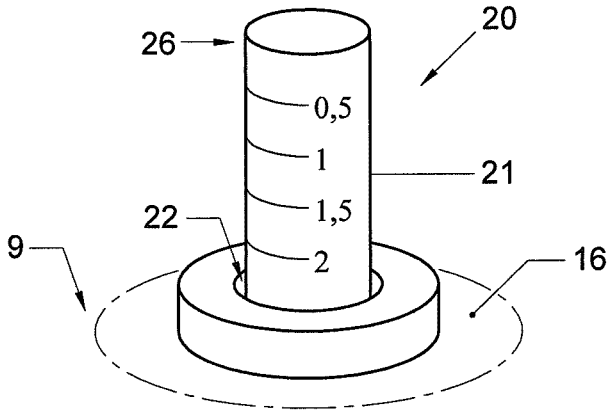
FIG. 4A shows, in perspective view, an indicator.

In FIG. 4A, in perspective view, a stem 21 is shown which extends to a point beyond the opening 22, while as example of a graduation, pressure is indicated in bar. In the position shown, an excess pressure of 2.5 bar is indicated.

Figure 5:
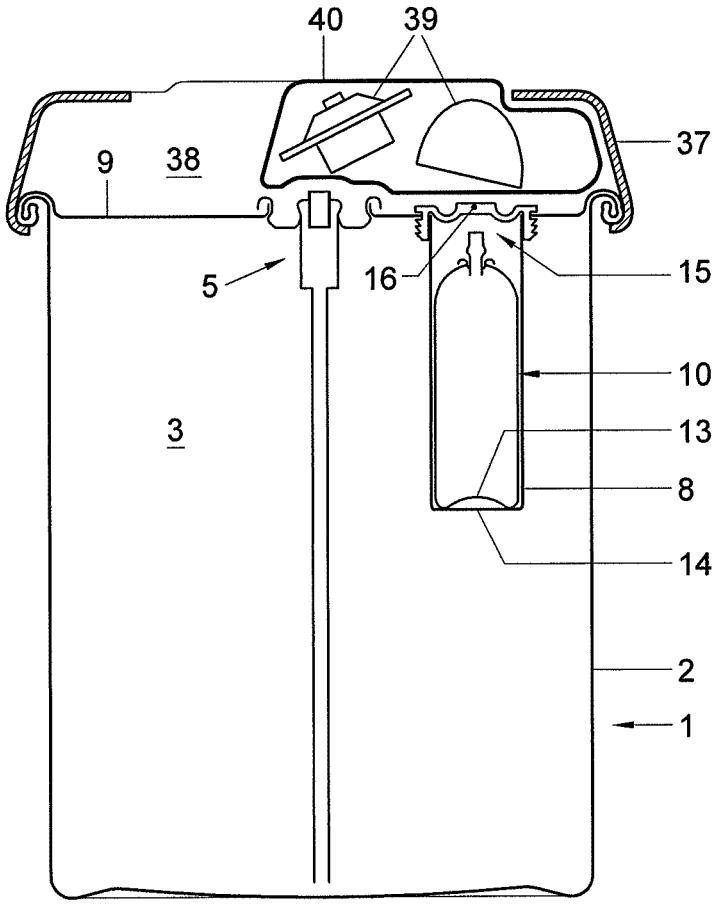
FIG. 5 schematically shows, in cross-sectional side view, an alternative embodiment of a tapping apparatus according to the invention.

FIG. 5 schematically shows, in cross-sectional side view, an apparatus 1 according to the invention, provided with a container 2 with a pressure control 10 in a holder 8, for instance as described hereinabove. A membrane 16 functioning as operating means 15 for the pressure control device is provided in an upper surface 9 of the container. On the upper side of the container, a top ring 37 is provided from which the container can for instance be lifted. The top ring 37 is manufactured from, for instance, plastic or metal and substantially encloses an inner space 38 above the upper side 9 of the container 2. In this inner space 38, as shown in FIG. 5, during storage and transport or at least prior to use in a store or the like, a packaging 40 is included in which at least a part of the tapping means 39 are included. This packaging 40 is for instance a blister pack. This preferably covers the operating means 15, so that they cannot be pressed in by a consumer or other person, before the tapping means 39 have been removed. This offers a simple protection against unintended use. The packaging can be connected to the top ring by, for instance, a seal so that a tamper evidence is obtained.

Figure 5A:
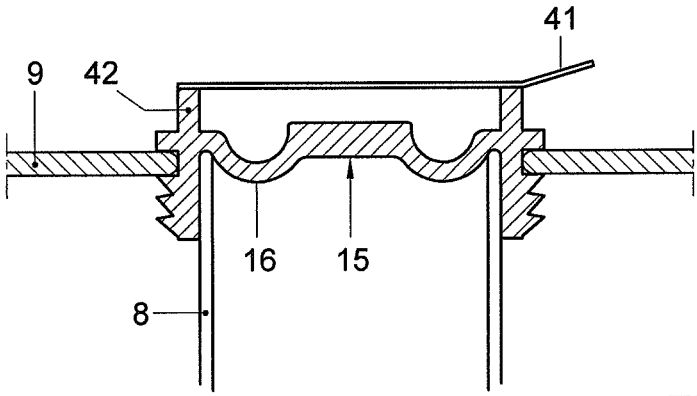
FIG. 5A shows an operating means covered by a seal.

In FIG. 5A, an alternative embodiment is shown, wherein the operating means are covered at a distance by a seal 41 or such cover which is provided on an edge 42 on or around the operating means 15. Here, a consumer will first have to pull the seal 41 away before the pressure in the container can be controlled, which is visible.

Figure 7:
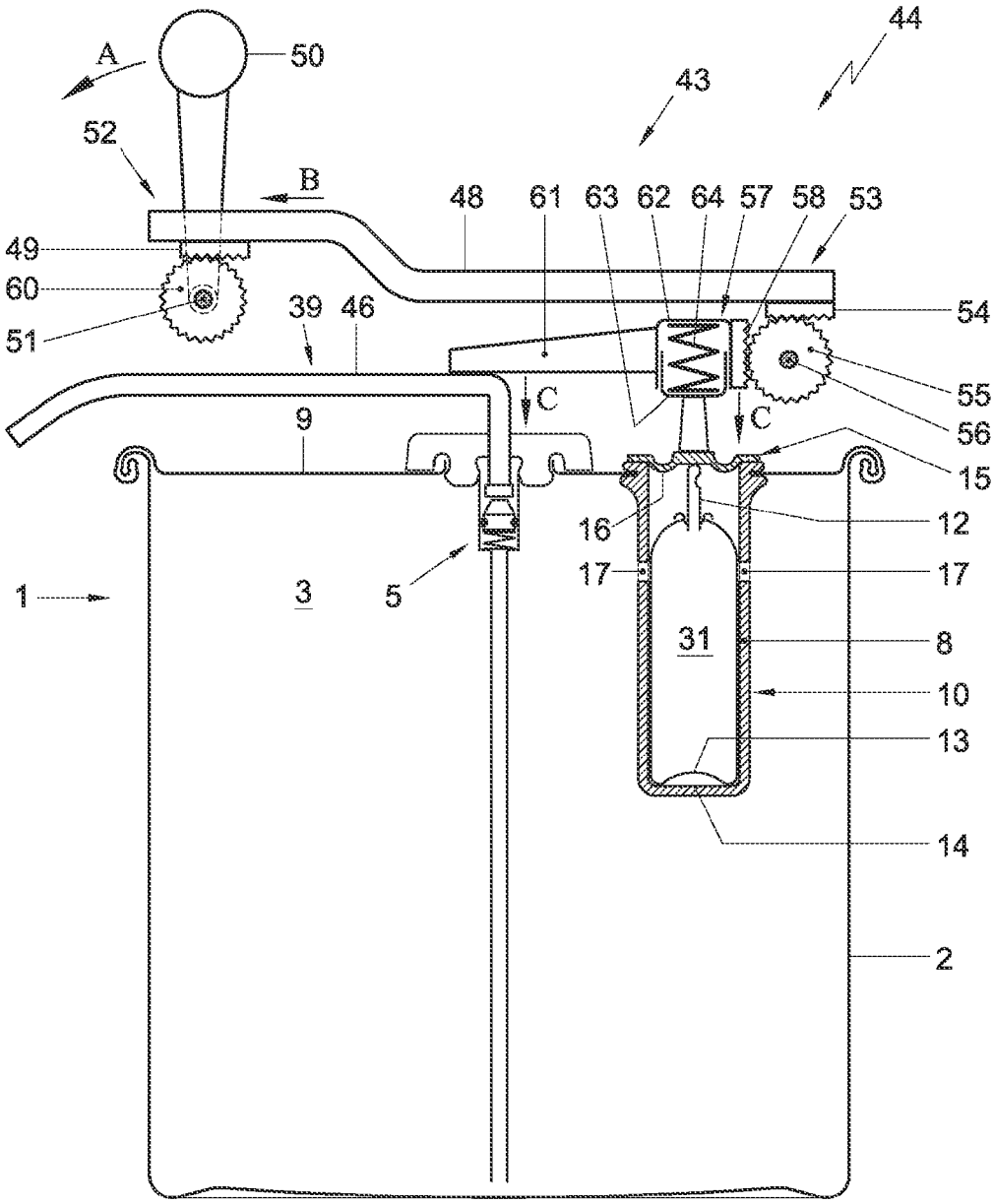
FIG. 7 schematically shows a further alternative embodiment of a pressure control in a container.
Figure 8:
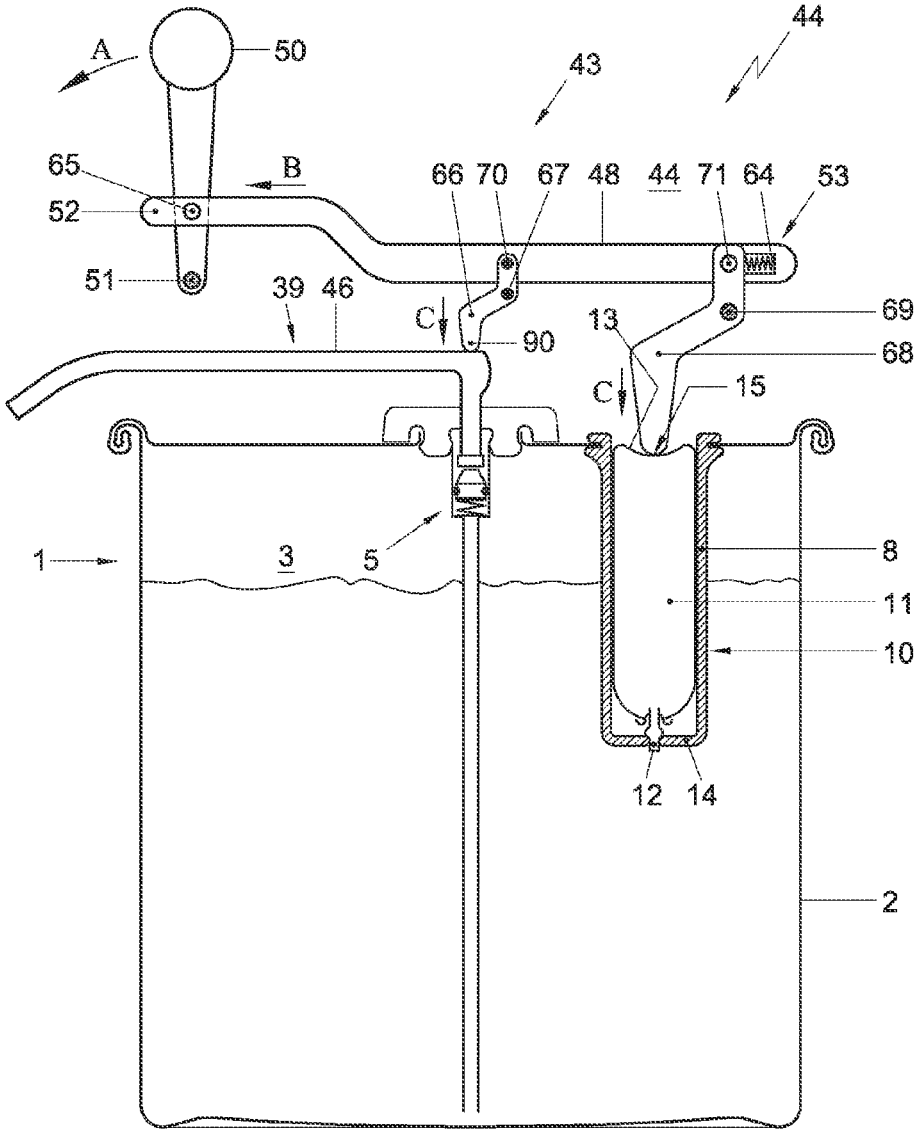
FIG. 8 schematically shows a tapping apparatus according to the invention with operating means operated by tapping means.

FIGS. 7 and 8 show embodiments wherein tapping means 43 are provided which are included in an apparatus 44 in which an apparatus 1 comparable to the one according to the invention, for instance as shown in FIG. 1 or 6, with a pressure control 10 and operating means 15 as described earlier or alternative embodiments thereof, can be included. Such an apparatus can comprise, for instance, cooling means for cooling the beverage. Furthermore, in the embodiments shown, such an apparatus is provided with said tapping means 43 for operating the valve 5, which comprise at least one outflow tube 46 for the beverage, which can be brought into fluid communication with the valve 5.

In the embodiment shown in FIG. 7, in the apparatus 44, for instance a lid thereof, a connecting rod 48 is included, which is provided on a first end 52 with a toothed rack 49. A tapping handle 50 mounted for rotation on an axis 51, is provided with a toothing, for instance a first sprocket 60 with which, through pivotal movement of the tapping handle 50 about said axis 51, in the direction A, the toothed rack and, hence, the connecting rod 48 is slid in a direction B. Adjacent the second end 53 of the connecting rod remote from the first end 52, a second toothed rack 54 is provided with which a second sprocket 55 can be rotated about a second axis 56, as the result of the movement of the connecting rod 48 in the direction B. A pressing element 57 is included, during use, above the operating means 15 of the container 2, which pressing element is provided at an outside with a toothing 58 which engages the second sprocket 55. Rotation of said second sprocket 55 in the same direction as the first sprocket 60 will then move the pressing element in the direction C, against the operating element 15, so that the valve 12 is pressed-in and gas will escape from the inner space 31 to the inner space 3 of the container 2. On the pressing element 57 further, an arm 61 is attached which moves along in the direction C and against the tapping means 39, or at least presses on the outflow tube 46 on the valve 5. Moving the pressing element downwards or at least in the direction C will therefore operate both the valve 12 of the pressure control and the valve 5 for beverage dispensing upon a pivotal movement of the tapping handle 50 in the direction A.

In the embodiment shown, the pressing element 57 is provided with an outer body part 62 with the toothing 58 and an inner body part 63 that is slideable therein, that rests on the operating means 15, at least the membrane 16. Between the inner 62 and the outer body part 63, a spring 64 is included. This is selected such that if the pressure in the inner space 3 of the container 2 obtains or exceeds a desired pressure, the spring 64 will be pressed-in so that the operation of the operating means 15 and, hence, the valve 12 is reduced or is even prevented, whereby too high a pressure is prevented. If the pressure in the inner space 3 drops below a desired minimum pressure, by contrast, the spring 64 will be able to activate the operating means 15 even when the tapping handle 50 is not operated.

In FIG. 8, an alternative embodiment of an apparatus 44 is shown, wherein the connecting rod 48 is connected, adjacent a first end 52, via a coupling 65, to the tapping handle 50, at a distance from the axis 51. A first pivot arm 66 is mounted on a second axis 67, a second pivot arm 68 on a third axis 69. The first 66 and second pivot arm 68 are pivotally connected to the connecting rod 48, at a distance from each other and of the first axis, via a first and second coupling 70,71. Displacement of the connecting rod 48 in the direction B through pivotal movement of the tapping handle 60 in the direction A will pivot the first 66 and second pivot arm 68 about the respective axes 67, 69. As a result, the end 90 of the first pivot arm 66 remote from the connecting rod 48 is pressed against the dispensing tube 46 or at least against the tapping means 39, so that beverage can be dispensed from the inner space 3. Furthermore, the end of the second pivot arm 68 remote from the connecting rod 48 is pressed against the operating means 15, in particular directly against the bottom 13 of the pressure container 11, thereby operating the valve 12.

In the embodiment shown, in an advantageous manner, a spring 64 is included in the connecting rod, between the second end 53 thereof and the coupling between the connecting rod 48 and the second pivot arm 68. Furthermore, in this embodiment, the valve 12 is inserted directly through an opening into the bottom of the holder 8, so that a movement of the pressure container 11 in the direction of the inner space 3 opens the valve and has gas escape to the inner space. Therefore, a membrane 16 is not required. Naturally, in this embodiment, the pressure control can also be designed differently, for instance as earlier described. If the pressure container 11 is pressed upwards by the pressure in the inner space, it will press the second pivot arm 68 back and pivot it about the second pivot 69. The coupling 71 will press the spring 64 in, without a displacement of the connecting rod being required. Conversely, if the connecting rod 48 is moved in the direction B for tapping beverage, if the pressure in the inner space 3 of the container 2 rises above a selected level, which depends on, for instance, the spring constant of the spring 64 and the proportions of the pivot arm 68 on both sides of the axis 69, this will result in no pivotal movement or a reduced pivotal movement of the second pivot arm 68 and, hence, a reduced operation of the valve 12. With this, too high a pressure can be prevented.

Figure 9:
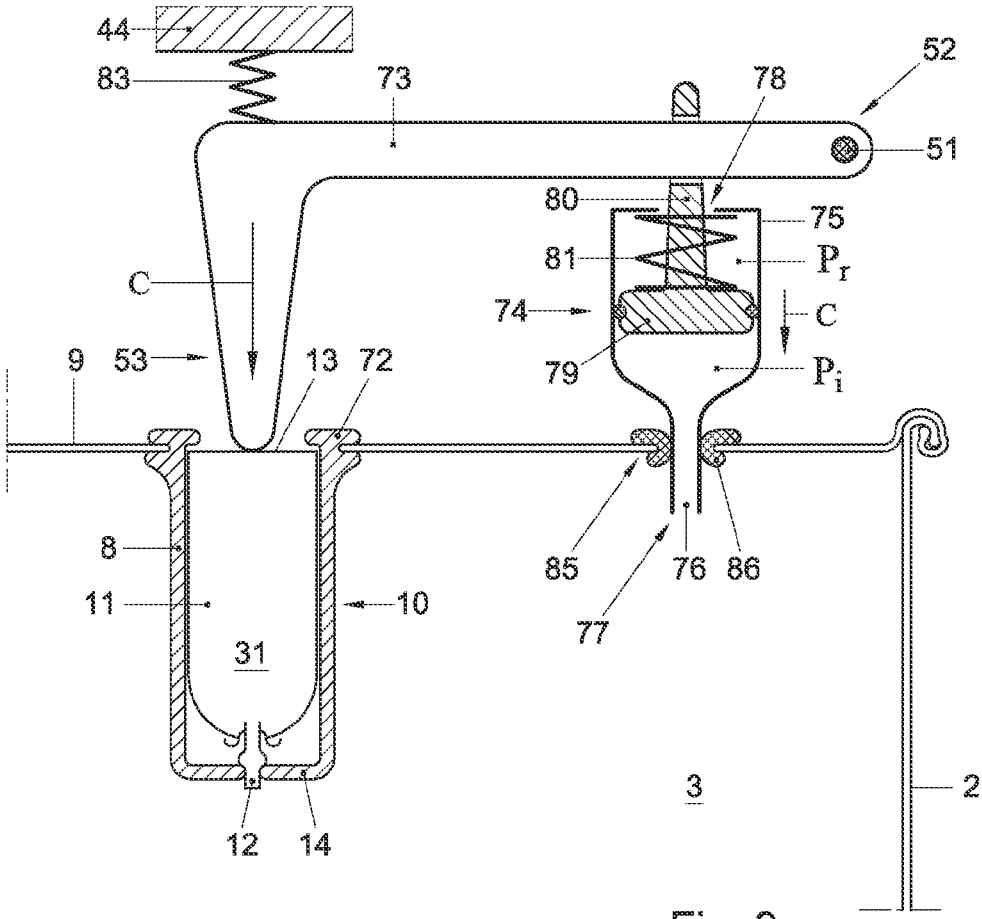
FIG. 9 schematically shows an alternative tapping apparatus according to the invention with operating means operated by tapping means.

FIG. 9 shows a further alternative embodiment, wherein a pressure control is included in an apparatus 44 in which the container can be placed. In this sense, this embodiment is comparable to the one according to FIGS. 7 and 8. Here is shown a part of the upper part of a container 2 with pressure control 10 as earlier described. This comprises a holder 8 with therein a pressure container 11 which reaches with the valve 12 through an opening in the holder 8, so that when the pressure container 11 is pressed in the direction of the inner space 3, gas under pressure flows from the inner space 31 of the pressure container 11 into the inner space and increases the pressure therein. In this embodiment, the pressure container 11 is confined in the holder 8 in that the bottom 13 thereof is captured below an edge 72. However, each of the embodiments shown and described hereinabove of a pressure control 10 according to the invention and alternative embodiments thereof can be utilized, with or without a membrane 16 as operating means 15. Means 39 for dispensing the beverage and the valve 5 are not shown.

In this embodiment, a pivot arm 73 is provided in the apparatus 44, which is mounted by a first end 52 on a pivot 51 and rests by an opposite, second end 53 on the bottom of the pressure control or, if an earlier described embodiment is utilized with membrane 16 as operating means 15, on the membrane 16. Between the first 52 and second end 53 a pressure control mechanism 74 is provided in the apparatus 44. This pressure control mechanism comprises a housing 75 with a spout 76 at a first side 77 and a partly open, opposite side 78. In the housing 75, a piston 79 is included, which has a piston rod 80 that reaches through the second side 78 and which is connected to the pivot arm 73, between the pivot 51 and the second end 53. Between the piston 79 and the second side 78 of the housing 75, a spring 81 may be included. Ambient pressure acts on the side of the piston 79 proximal to the second side 78, together with the spring pressure, so that a control pressure $P_r$ is set. The pivot arm 73 can bear, adjacent the second end, by a second spring 83, against the apparatus 44, so that a bias in the direction of the pressure container 11 is obtained, or the pivot arm can be pressed away against the spring pressure by the pressure container, if the pressure thereon from, for instance, the inner space exceeds the spring tension. In the embodiment shown, the container 2 comprises, on the side proximal to the pivot arm 73, in the upper surface 9 an opening 85, sealed off by for instance a pierceable sealing element 86 such as a rubber, a cap from plastic, a material weakening or the like through which the spout 76 can be pressed, for instance when a lid of the apparatus is closed by manually pressing the spout 76 therethrough.

During use, the spout 76 is pressed through the opening 85, so that the pressure in the inner space 3 of the container 2 will act on the piston 79, on the side remote from the pivot arm 73, against the control pressure $P_r$. If the pressure $P_i$ in the inner space 3 corresponds to the control pressure $P_r$, the piston 79 will be in a neutral position and the second end 53 of the pivot arm 73 will not press the pressure container 11 in the direction of the inner space 3. As soon as the pressure $P_i$ in the inner space 3 decreases, for instance in that beverage is tapped, the control pressure $P_r$ will press the piston towards the inner space 2, thereby pulling the pivot arm along. As a result, the second end 53 of the pivot arm 73 is pressed against the pressure container 11 or, if present, an operating means 15, so that this is pressed in the direction of inner space 3. The valve 12 is then opened and gas under pressure flows into the inner space 3. As a result, the pressure in the inner space 2 increases again whereby the piston is returned in the direction of the neutral position and the valve 12 is closed again. Here, the pressure in the vicinity of the container functions therefore at least as reference pressure.

Figure 9A:
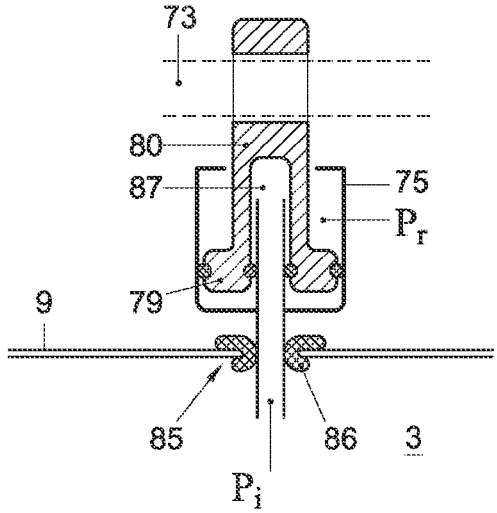

In an alternative embodiment, the spring 81 can be omitted when the internal pressure $P_1$ acts on a smaller surface than the ambient pressure, in a ratio such that the resulting pressure corresponds to the desired control pressure $P_r$. To that end, for instance the spout 76 can continue cylindrically into a hollow core 87 of the piston, as schematically shown in FIG. 9A.

The control pressure $P_r$ can be made to be adjustable, for instance by making the spring tension of the spring 81 adjustable, for instance by axial displacement of the housing relative to the piston, through modification of the proportion between the length of the pivot arm between the pivot 51 and a second end 51 and the distance between the piston 79 and the pivot 53 or by modifying the height of the pivot arm 73 above the container 2. Many variations thereon will be directly clear to the skilled person. On the pivot arm 73, an operating means can be provided for opening the valve 5, for instance as described on the basis of FIG. 7 or 8, while furthermore, the possibility can be offered to press the pivot arm manually downwards, if a user desires to do so, so that the pressure can be increased manually.

Figure 10:
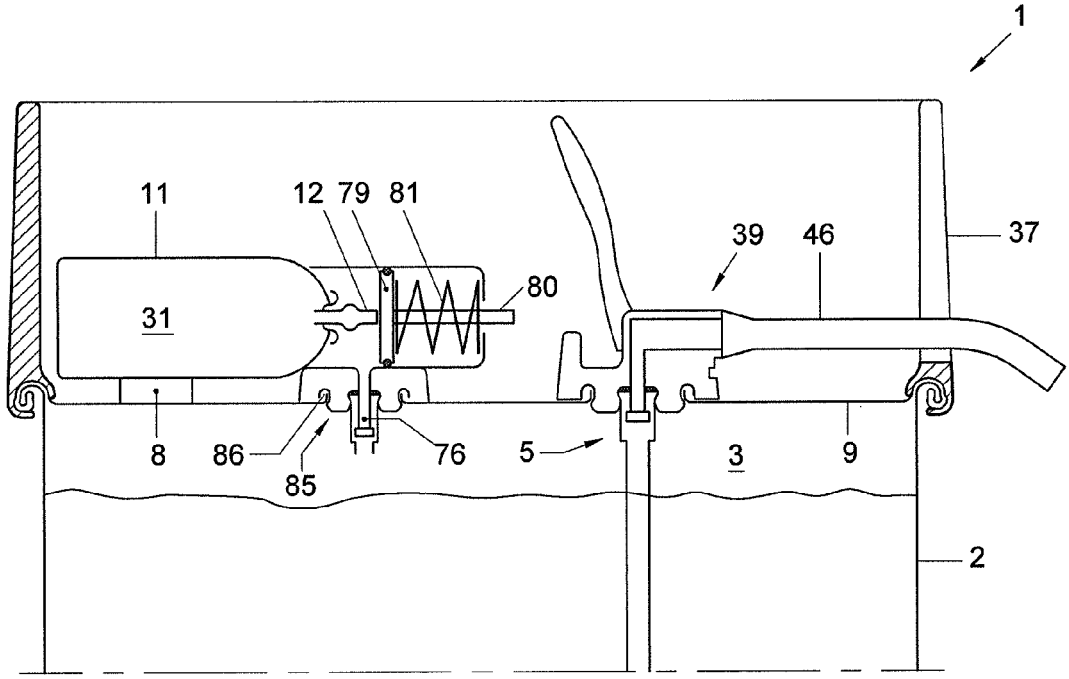
FIGS. 10 and 10A schematically show further alternative embodiments wherein the pressure container is placed outside the container.
Figure 10A:
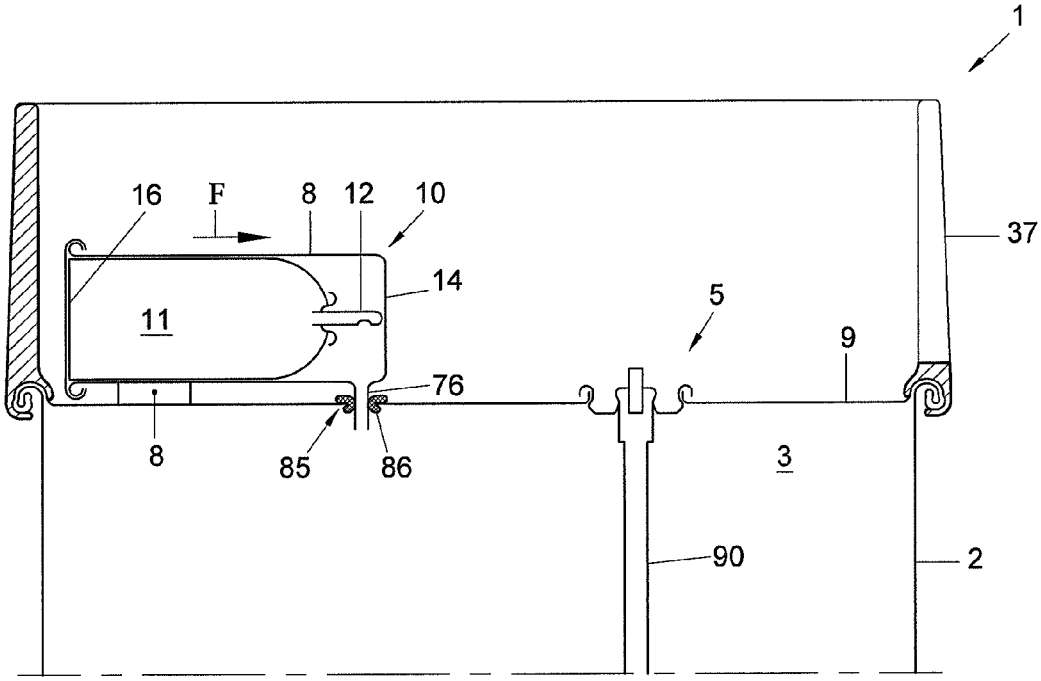

FIGS. 10 and 10A schematically show alternative embodiments of an apparatus 1 according to the invention, wherein the pressure container 11 is provided outside the inner space 3. Here, in these embodiments, the holder 8 is included in a top ring 37. Below the holder 8, an opening 85 is provided through which the inner space of the holder is, or can be brought into communication with the inner space 3 of the container 2, preferably after filling of the container 2. The holder is provided with, for instance, a spout 76 which, in the brewery or bottling plant, can be pressed through the opening 85, for instance when placing the top ring. This may be advantageous if the top ring is placed after filling of the container. Alternatively, the holder 8 or at least the spout 76 can be pressed by the user through the opening 85, so that the connection is made only when the user wants to "tap" the container for a first use. Naturally, the spout 76 can also be directly connected to the pressure container 11. Optionally, the holder can be attached in or on the container and only the pressure container 11 needs to be placed, for instance by a consumer.

In FIG. 10, by pressing the stem 80 and in FIG. 10A by pressing the membrane 16, gas can be supplied to the inner space 3 of the container.

In each of the embodiments shown, instead of or in addition to the pressure control controlled by the user, a pressure control device or pressure control controlled at least on the basis of the ambient pressure can be provided, for instance as shown in FIG. 9, 9A or 10, or technically and/or functionally comparable therewith.

The invention is not limited in any manner to the embodiments represented in the description and the drawing. Many variations thereon are possible within the framework of the invention as outlined by the claims. For instance, combinations of parts of the embodiments shown can be combined, in particular control devices 10, tapping means 39 and/or apparatuses 44. The holder 8 can be integrally formed with the container 2, in particular with a wall such as the upper side thereof, or can be manufactured and placed as separate part. Also, a holder 8 can be omitted, by securing the pressure container 11 in an opening in the container 2 or otherwise.

In an advantageous embodiment, the pressure container is provided in the container 2 in an advanced production phase, for instance directly prior to or even after filling the inner space with beverage. To that end, the holder 8 can be provided with means that are pierced through the pressure container or operating means 15 thereto, so that the inner space of the container after filling can be completely sealed off from the surroundings while operation of the pressure container is prevented until is it actively energized by a user prior to use. The pressure container 11 can form an integral part of the container 2, for instance a separate integral compartment.

These and many comparable variations are understood to fall within the framework of the invention as outlined by the claims.

The invention claimed is:

1. A tapping apparatus, provided with a container and a pressure control device for controlling pressure in an inner space of the container, wherein the pressure control device comprises a compartment with a pressure medium therein and a dispensing opening with a valve mechanism, wherein operating means are provided for operation of the valve mechanism by a user, for supplying an amount of pressure medium from the compartment into an inner space of the container, wherein the inner space of the container is at least partly filled with a carbonated beverage, wherein dispensing means are provided for dispensing beverage from the inner space of the container, which dispensing means comprise a valve closing off a dispense opening.

2. A tapping apparatus according to claim 1, wherein the operating means are operable by a user from an outside of the container.

3. A tapping apparatus according to claim 2, wherein the dispensing means are coupled to the operating means, the arrangement being such that upon operation of the dispensing means such that a part of the beverage is dispensed from the inner space, the operating means are driven for dispensing from the compartment an amount of pressure medium to the inner space of the container.

4. A tapping apparatus according to claim 1, wherein the dispensing means are coupled to the operating means, the arrangement being such that upon operation of the dispensing means such that a part of the beverage is dispensed from the inner space, the operating means are driven for dispensing from the compartment an amount of pressure medium to the inner space of the container.

5. A tapping apparatus according to claim 1, wherein the operating means are accessible from an outside of the container with a hand of a user.

6. A tapping apparatus according to claim 1, wherein an indicator is provided for indicating the pressure in the inner space of the container.

7. A tapping apparatus according to claim 6, wherein the indicator is a mechanical indicator.

8. A tapping apparatus according to claim 6, wherein the indicator comprises a moving element which is movable between a first and a second position, wherein the first position indicates a low pressure in the inner space and the second position a high pressure.

9. A tapping apparatus according to claim 6, wherein the indicator is at least partly included in the operating means.

10. A tapping apparatus according to claim 6, wherein the indicator comprises means for discharging excess pressure from the inner space.

11. A tapping apparatus according to claim 1, wherein the operating means are provided with a control element with which a maximum pressure that can be exerted on the operating means is or can be set.

12. A tapping apparatus according to claim 1, wherein the valve mechanism comprises a spring-loaded valve body, while the operating means are designed for operating said spring-loaded valve body.

13. The tapping apparatus according to claim 12, wherein the spring-loaded valve body is a valve.

14. The tapping apparatus according to claim 12, wherein the spring-loaded valve body is an aerosol valve.

15. The tapping apparatus according to claim 12, wherein the operating means are designed for operating said spring-loaded valve body by moving the valve body against the spring load.

16. A tapping apparatus according to claim 1, wherein the pressure control device is included at least partly within the inner space of the container, while in an outer wall of the container the operating means are provided.

17. The tapping apparatus according to claim 16, wherein the operating means are provided in an upper side of the outer wall of the container.

18. The tapping apparatus according to claim 16, wherein the operating means are provided adjacent an upper side of the outer wall of the container.

19. A tapping apparatus according to claim 1, wherein the pressure control device is included substantially outside the inner space of the container, while in an outer wall of the container the operating means are provided.

20. The tapping apparatus according to claim 19, wherein the operating means are provided in an upper side of the outer wall of the container.

21. The tapping apparatus according to claim 19, wherein the operating means are provided adjacent an upper side of the outer wall of the container.

22. A tapping apparatus according to claim 1, wherein the operating means in a first position, prior to a first use, are at least functionally uncoupled from the valve.

23. A tapping apparatus according to claim 1, wherein the operating means are provided with tamper evident means.

24. The tapping apparatus according to claim 23, wherein the tamper evident means are a seal.

25. The tapping apparatus according to claim 23, wherein the tamper evident means are a cover.

26. A tapping apparatus according to claim 1, wherein a pressure control controlled on the basis of at least ambient pressure is provided for supplying, from a container, a pressure gas into a beverage compartment.

27. The tapping apparatus according to claim 1, wherein the carbonated beverage is beer.

28. A method for tapping beverage, wherein the beverage is included in a container with a dispensing device, which container is further provided with a compartment with a compressed pressure medium, wherein, with the aid of operating means, a shut-off of the compartment is operated such that pressure medium flows under pressure into an inner space of the container and then pressurizes the beverage and beverage is discharged from the inner space by operation of the dispensing device, and wherein the shut-off of the compartment is accomplished at least partly by repeatedly opening and closing a valve of a pressure cartridge within the compartment by a user, in between dispensing beverage, for manually increasing the pressure inside the container.

29. A method according to claim 28, wherein the operating means are operated by the dispensing device.

* * * * *

UNITED STATES PATENT AND TRADEMARK OFFICE

CERTIFICATE OF CORRECTION

PATENT NO. : 8,444,011 B2
APPLICATION NO. : 12/515001
DATED : May 21, 2013
INVENTOR(S) : Paauwe et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 920 days.

Signed and Sealed this
Eighth Day of September, 2015

Michelle K. Lee

Michelle K. Lee
*Director of the United States Patent and Trademark Office*